United States Patent [19]

Strauch et al.

[11] 4,109,573

[45] Aug. 29, 1978

[54] ARTICLE, SCREEN AND SQUEEGEE DRIVE FOR SCREENPRINTER

[75] Inventors: Karl Strauch, Kirchlengern; Wilfried Kammann, Bunde, both of Germany

[73] Assignee: Werner Kamman Maschinenfabrik, Buende, Germany

[21] Appl. No.: 702,861

[22] Filed: Jul. 6, 1976

Related U.S. Application Data

[63] Continuation of Ser. No. 541,411, Jan. 6, 1975, Pat. No. 4,005,649.

[30] Foreign Application Priority Data

Jan. 22, 1974 [DE] Fed. Rep. of Germany ..... 2402836

[51] Int. Cl.[2] ..... B41F 15/10; B41F 15/30

[52] U.S. Cl. ..... 101/38 R; 101/115; 101/123; 101/126

[58] Field of Search ..... 101/115, 123, 124, 126, 101/129, 38 R, 38 A, 39, 40

[56] References Cited

U.S. PATENT DOCUMENTS

| | | | |
|---|---|---|---|
| 3,251,298 | 5/1966 | Rudolph et al. | 101/123 |
| 3,521,298 | 7/1970 | Morel et al. | 101/126 X |
| 3,762,318 | 10/1973 | Dubuit | 101/38 R |
| 3,874,289 | 4/1975 | Valentin | 101/126 X |

*Primary Examiner*—Ronald E. Suter
*Attorney, Agent, or Firm*—Michael J. Striker

[57] ABSTRACT

A screenprinting machine has at least one printing station past which an object to be printed travels in a path, and which includes a movable printing screen and a cooperating movable squeegee. A fixed rack extends along this path, and an arrangement is provided which engages and rotates the object to be printed and which includes a gear which meshes with the rack. A drive is provided for moving the squeegee at a constant rate of speed, and another arrangement serves to vary the speed of movement and the stroke of the printing screen in dependence upon the peripheral speed of the rotating object.

29 Claims, 13 Drawing Figures

ARTICLE, SCREEN AND SQUEEGEE DRIVE FOR SCREENPRINTER

This is a continuation of application Ser. No. 541,411, filed Jan. 16, 1975, now U.S. Pat. No. 4,005,649.

BACKGROUND OF THE INVENTION

The present invention relates generally to a screen-printing machine, and more particularly to a screen-printing machine having one or more printing stations each of which has at least one movable printing screen and at least one cooperating movable squeegee.

In particular the present invention relates to a screen-printing machine for printing of objects which are being rotated as they travel through the printing machine.

In many instances it is desired to provide an object with a plurality of items of print (e.g. pictures, logos, text or the like) in a single operation, that is in a single pass through the screen printing machine. Each image is to be applied by a different one of the printing stations. Often these objects are in form of cans, bottles or similar elements which are required to be provided with the respective printed images on different portions of their circumference, and which must therefore be rotated during their pass through the printing machine. For this purpose it is known to provide a drive, including a rack which extends past one or more of the printing stations, serving to effect the desired rotation of the object to be printed. If the rack extends past two or more of the printing stations of the printing machine, then it is not necessary to properly orient the object with reference to the printing screen at each successive printing station, since the relative angular position of the object to the respective printing screen is fixed as soon as the object is engaged by its engaging device and the gear, which is connected with the engaging device, meshes with the aforementioned stationary rack.

The concept behind these prior art proposals is advantageous, but the prior art screen-printing machines of this type do have certain disadvantages. Among these is the fact that whenever the diameter of the object to be printed changes, that is if a series of smaller-diameter cans is followed by a series of larger-diameter cans, to name an example, the diameter of the gear which meshes with the fixed rack must be correspondingly changed; in other words, the gear must be replaced with one having a different diameter. This is evidently disadvantageous. Furthermore, the stroke of the squeegee must also be adjusted to the diameter of the different objects to be printed, whenever a change occurs in this diameter. If the screen-printing machines are of the type having two or more printing stations, then the spacing between the individual printing stations must be changed in dependence upon the differential diameters of the objects when a change in the diameters occurs.

SUMMARY OF THE INVENTION

Accordingly, it is a general object of this invention to overcome the disadvantages of the prior art.

More particularly, it is an object of the present invention to provide an improved screen-printing machine which is not possessed of the aforementioned disadvantages.

Another object of the invention is to provide a screen-printing machine of the type in question which is considerably simplified in its structure and operation as compared to the prior-art machines of this type.

An additional object of the invention is to provide such an improved screen-printing machine wherein it is possible to maintain a fixed spacing between successive printing stations of the machine, despite variations in the diameters of the objects to be printed.

Another object is to provide such a printing machine in which each of the objects to be printed can be properly placed in its angular starting position at the beginning of each printing operation irrespective of its diameter.

A concommitant object is to provide such a screen-printing machine in which it is possible to supply the objects to be printed in a simple manner into the machine, and to remove them in a similarly simple manner from the machine after the printing operation is completed.

Still a further object of the invention is to provide a screen-printing machine of the type in question which has an improved range of applicability, and wherein it is possible to provide in a single printing station simultaneously two or more printed images on portions of a single object having different diameters.

In keeping with these objects, and with others which will become apparent hereafter, one feature of the invention resides in a screen-printing machine which, briefly stated, comprises at least one printing station past which an object to be printed travels in a path, and which includes a movable printing screen and a cooperating movable squeegee. A fixed rack extends along the path. Means is provided for rotating the object to be printed, including a gear meshing with the rack. Means is provided for moving the squeegee at a constant rate of speed, and additional means serves for varying the speed of movement and the stroke of the printing screen in dependence upon the peripheral speed of the rotating object.

A printing screen constructed according to the present invention assures that the path of transportation of the object to be printed is always constant, independently of the diameter of the object. The variations resulting from differential diameters of different objects are compensated-for by appropriate variations in the speed of movement and the stroke of the printing screen. The squeegee on the other hand, can perform movements at a constant rate of speed and have strokes of constant length.

One of the significant improvements of the present invention over what is known from the prior art is that resort to the present invention eliminates the need for changing the gear which rotates the object to be printed and meshes with the fixed rack, whenever different objects having different diameters are being printed. This, as pointed out before, was previously absolutely necessary in each such circumstance.

If the screen-printing machine according to the present invention has two or more successively arranged printing stations, the constancy of the length of the travel path to be traversed by the objects being printed assures that after the object has traversed a path of a certain length it will be in its appropriate starting position for the next printing operation taking place at the next printing station, irrespective of the diameter of the object.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
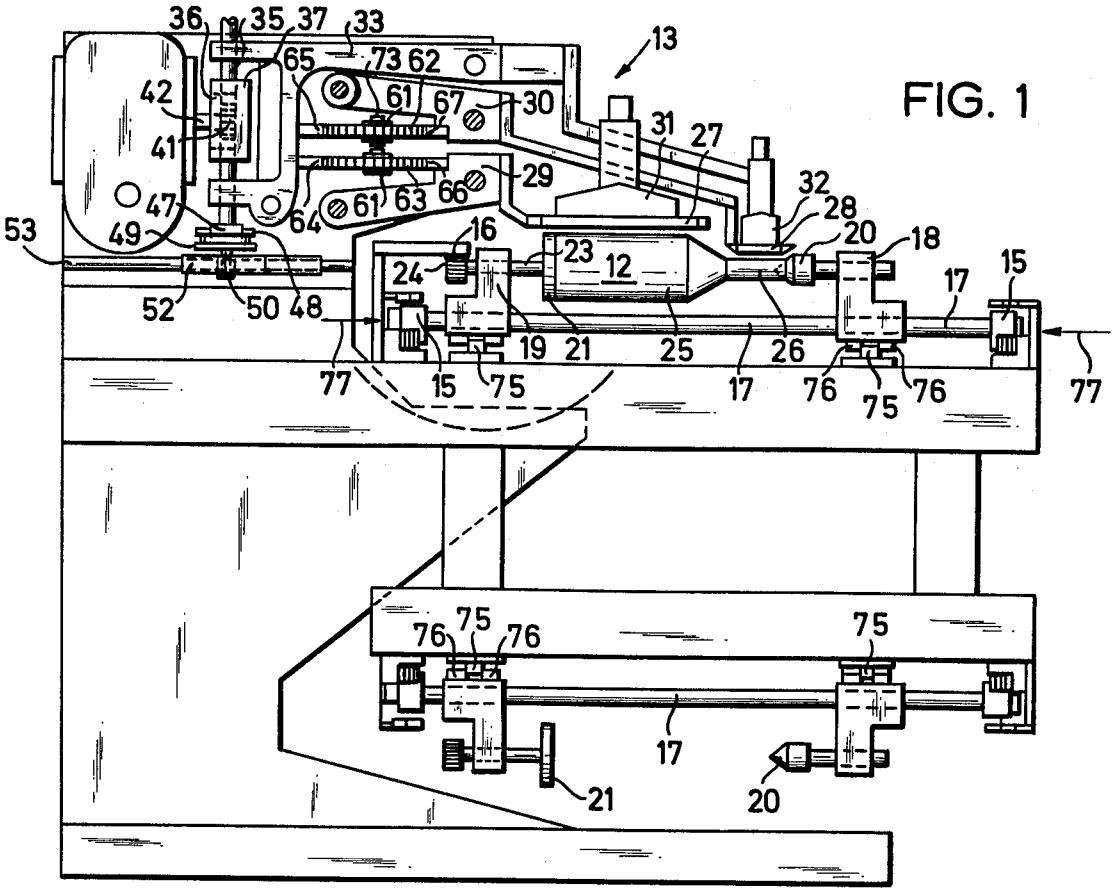
FIG. 1 is a somewhat diagrammatic end view of a screen-printing machine according to one embodiment of the invention.

FIGS. 1–6 illustrate one embodiment of the invention. In these Figures, the arrow 11 identifies the direction in which objects 12 that are to be printed, travel in the screen-printing machine, to be successively imprinted at the printing stations 13 and 14 thereof. A conveyor is provided which in the illustrated embodiment is formed of two endless chains 15 which travel in parallelism with one another in two vertical planes so that each chain has an upper run and a lower run. A stationary rack 16 extends along that region of the conveyor in which the printing stations 13 and 14 are located; it extends in parallelism with the conveyor and with the direction 11 in which the objects 12 travel. The objects 12, incidentally, are in this case shown by way of example as bottles having a body 25 of a first diameter and a neck 26 of a different second diameter. The chains 15 are provided with traverse members 17 that are spaced from one another in the direction 11 and which carry mounts 18 and 19 that are shiftable relative to one another. Each of the mounts carries a centering element, the mount 18 carrying the centering element 20 and the mount 19 carrying the centering element 21. One of these centering elements here the element 20, is constructed with a tip or projection that engages one end of the object 12, and the other centering element, here the element 21, is constructed as a seat which engages the opposite end of the object 12. Between them, the centering elements 20, 21 move the object 12. The element 21 is provided with a shaft 23 having an end that carries a gear 24 which meshes with the teeth of the rack 16 as long as the gear 24 travels along the rack 16, that is as long as it is in the region where the rack 16 is provided.

It is assumed in the illustrated embodiment that it is desired to provide the printing of images both on the body 25 and on the neck 26 of the respective object 12. Sine they have different diameters, it is necessary to associate different printing screens 27, 28 with them in each of the printing stations. The two printing screens 27, 28 are mounted in carriages 29, 30, respectively, which are movable independently of one another. The printing screens 27, 28 have associated with them respective squeegees 31, 32 which are mounted on a common carriage 33. The latter is formed with two bolts or pins 34, 35 on which an element 37 can move vertically up and down. The element 37 is formed with an internal hollow bounded by inner circumferential surface which is formed with a toothed track 36 having two linear track sections 38 which both extend parallel to the direction 11, and two terminal arcuate track sections 39 which connect the linear track sections 38 at the opposite ends thereof. A pinion 14 is mounted on a shaft 42 and meshes with the teeth of the track 36. It will be appreciated that when the shaft 42 and the pinion 41 rotate in the direction of the arrow 43 (see FIG. 4) the element 37 will move in the direction 11 as long as the teeth of the pinion 41 are in engagement with the upper linear track section 38. When the pinion 41 reaches the arcuate track section 39 which is the right-hand one in FIG. 4, the element 37 will perform an upward movement on the pins 34, 35 until the pinion 41 begins to mesh with the teeth of the lower linear track section 38. At this time, the element 37 will travel opposite to the direction 11 until the pinion 41 engages with the left-hand arcuate track section 39, which will then cause the element 37 to move downwardly on and relative to the pins 34, 35. When this movement is completed, the element 37 will be back in the position illustrated in FIG. 4. The linear movements of the element 37 are transmitted to the carriage 33 for the squeegees 31, 32, whereas the up and down movements of the element 37 only cause the element to perform relative movements with respect to the carriage 33 along the pins 34, 35.

To assure that the pinion 41 remains in engagement with the track 36, the element 37 is provided with a track 44 extending parallel to the track 36 (see FIG. 5) in which a follower roller 45 is received and guided. The follower roller 45 is mounted on a shaft 46 which extends coaxially through the shaft 42 for the pinion 41.

At the lower end of the respective pins or bolts 34, 35 there are mounted respective control members 47. These control members are located between and flanked by guide rolls 48 arranged in pairs on respective plates or carriages 49. Of course, instead of rolls 48 it would be possible to provide other kinds of guide projections. Each plate is supported on a pivot 50 (see FIG. 6) in a control slide 51 or 52, respectively, so that it can turn relative thereto. The control slides 51 and 52 in turn are guided on rods 53 for reciprocation in the direction of the arrows 54, 55. Each control slide is provided with a lateral set of teeth forming a rack 56, and each of these meshes with gears on a gear segment 57 and 58, respectively. The gear segments are mounted on shafts 59 which in turn each carry an arm 60 that turns with the respective shaft 59 and has articulated to one end a linking member 61; the ends of the linking members in turn carry the shafts of intermediate gears 62 and 63, respectively. The intermediate gears 62 and 63 mesh with two racks 64, 66 and 65, 67 respectively; the racks 64 and 65 are carried by the carriage 33 and racks 66 and 67 are carried by one of the carriages 29 or 30.

When the carriage 33 performs its movements in the direction of the arrow 11, and opposite thereto, which are imparted to it in response to the movements of the element 37, the control members 47 cause corresponding to-and-fro movements of the slides 51 and 52 in the direction of the arrows 54, 55, when the control members 47 are so oriented as to extend at an inclination to the direction of movement performed by the carriage 33. The reason for this is that the control members 47 are guided between the turnable guide rolls 48 so that due to the movement of the carriage 33 in and opposite to the direction of the arrow 11 force components will be transmitted via the plate 49 and the associated pivot 50 to the respective slide 51, 52, leading to their movement in the direction of the arrows 54, 55. This, in turn, causes oscillatory movements of the gear segments 57 and 58 which are transmitted to the gears 62 and 63, causing the same to perform similar oscillatory movements.

For any given squeegee-supporting carriage 33, the movement or strokes of the carriage 33 carried out in the direction 11 and opposite thereto is constant. Since the diameter of the gear 24, which effects rotation of the objects 12 to be printed, is to be unchanging irrespective of the diameter of the objects 12, it is necessary to accommodate the movements of the carriages 29 and 30 to the differential circumferential speeds of the objects 12, which circumferential speeds of course depend upon the diameter of the objects 12. For this purpose the stroke or movement performed by the respective gears 62 and 63 is adjusted. This adjustment in turn is dependent upon the orientation of the control members 47 and the slides 51, 52 during a given starting position of the carriage 33. This means that by an appropriate setting of the control members 47, the movements performed by the two printing screens 27, and 28 and the speed of these movements, can be set in dependence upon the diameters of the objects 12, e.g. in the case of FIGS. 1–6 upon the diameters of the portions 25, 26 that are to be printed. The presence of the two intermediate gears 62, 63, two slides 51, 52, two control members 47 and similar duplications results from the fact that in the embodiment of FIGS. 1–6 two separate portions 25, 26 of the objects 12 are to be simultaneously printed, and that these portions have different diameters. As a general rule, the objects to be printed will only have a single diameter, or else only a portion having a single diameter is to be printed; if this is the case, then it will of course only be necessary to provide a single intermediate gear 62 or 63, a single slide 51 or 52, a single control member 47, etc.

The upper ends of the bolts or pins 34, 35 are formed with quadratic or hexagonal end portions 70 or the like, to permit their engagement and turning by means of tools. This makes it possible to turn the pins 34, 35 about their longitudinal axes, to thereby at the same time effect pivoting of the control members 47 to selected different orientations. Of course, it must be assured — for example by appropriate releasable clamping devices or the like, which are known in the art and require no detailed description — that the bolts or pins 34, 35 and the control members 47 carried by them, will remain in their selected relative position with reference to the carriage 33 and cannot be unintentionally pivoted, for example under the influence of external forces.

It is clear that the control members 47 can assume a neutral position in which they will not cause any movements of the slides 51, 52 in the direction of the arrows 54, 55, even though the element 37 and the carriage 33 may move in and opposite to the direction of the arrow 11. This neutral position exists when the control members 47 extend parallel to the direction 11. As soon, however, as the control members 47 assume a position in which they are inclined relative to the direction 11 at an angle greater than 0, they will inherently cause a movement of the slides 51, 52 in the directions of the arrows 54, 55 in response to the movement of the carriage 33 in and opposite to the direction of the arrow 11, thereby causing the earlier explained movements of the gears 62 and 63.

When the control members 47 are in the aforementioned neutral position, the rotation of the respective gears 62 and 63 results only from the to-and-fro movement of the racks 64 and 65 carried by the carriage 33. In this case, the carriage 33 and the printing-screen carriages 29, 30 are moved in mutually opposite directions at identical speed and through identical distances. This neutral setting of the control members 47 will be utilized if the diameter of the object 12 to be printed or of the portion thereof that is to be printed, corresponds to double the diameter of the gear 24 which meshes with the fixed rack 16.

Figure 7:
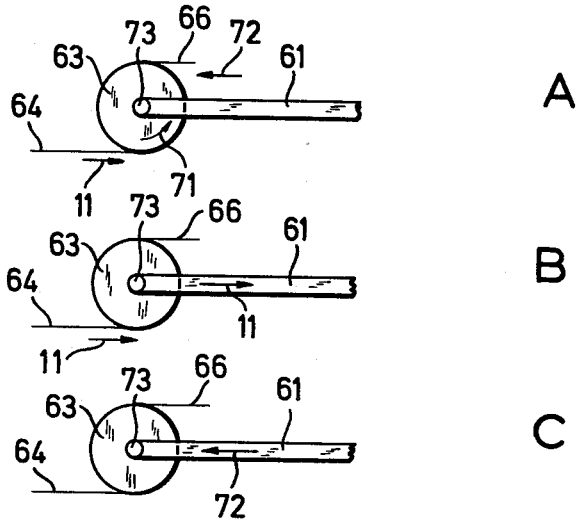
FIGS. 7*a*, 7*b* and 7*c* are diagrams illustrating the drive of the printing screen in FIGS. 1–6 under different circumstances.

This operating condition is diagrammatically illustrated in FIG. 7A wherein it will be seen that the rack 64 carried by the carriage 33 is moved by the latter in the direction of the arrow 11, causing the intermediate gear 63 to rotate in the direction of the arrow 71 and leading to a movement of the rack 66 that is carried by the carriage 29; this movement of the rack 66 is in the direction of the arrow 72, that is opposite to the direction 11 and is caused exclusively by the rotation of the intermediate gear 63 and therefore by the movement of the rack 64.

If the single or several control members 47 are inclined to the direction 11 in which the carriage 33 moves, there will additionally be obtained a shifting to and fro of the axis 73 of the intermediate gear 63, it being desired to shift the axis 73 and therefore the intermediate gear 63 in the direction of the arrow 11 during the printing operation. This situation is shown in FIG. 7B and it will be appreciated that in this case the gear 63 is subject to two forces one of which is transmitted to it from the linking member 61 via the axis 73 whereas the other is transmitted to it in the manner already described via the rack 64 of the carriage 33 directly to the teeth of the gear 63. The extent and speed of motion transmitted to the gear 63 via the linking member 61 are selectable, by varying the orientation of the associated conrtol member 47, which makes it possible to vary the absolute movements of the printing screen associated therewith; this means that it is also possible to vary the relative movements between printing screen on the one hand, and object 12 on the other hand. The control member or members 47 can be so set that the axis 73 of the intermediate gear 63 is caused to move in a translatory manner during the printing operation, in the same manner as the carriage 33 and in the direction of the arrow 11; the extent of the mutually opposite movements of the carriage 33 on the one hand and the carriage 29 or 30 on the other hand decreases as the translatory movement of the axis 73 increases in the direction of the arrow 11. This means that the stroke of the rack 66 and the associated printing screen decrease.

FIG. 7C shows that if the control member or members 47 are set to a position in which the axis 73 of the intermediate gear 63 is caused to perform a translatory movement in the direction of the arrow 72, the rack 66 and the associated printing screen will perform in the direction of the arrow 72 a stroke which is larger than the stroke of the rack 64 and the carriage 63 which takes place in the opposite direction, that is in the direction of the arrow 11.

The variations in the length of the respective stroke which are caused in dependence upon the setting of the control members 47 (see the preceding explanations), also cause a variation in the speed with which the printing screen travels, due to changes in the rotary speed of gear 63 upon which the translatory movement thereof is superimposed. In this manner it is possible to accommodate the movements of the respective printing screen to the different peripheral or circumferential speeds of the object 12 to be printed, and of course these different peripheral speeds will depend upon the diameter of the object.

It will be understood that while the possibilities of adjustment have been discussed above with respect to the intermediate gear 63, the same explanations are valid also with respect to the intermediate gear 62, or for any other intermediate gear that may be utilized.

In operation, the objects 12 to be printed are placed upon the conveyor formed by the chains 15 upstream (with respect to the direction of movement 11) of the first printing station 13 and are engaged and held by the centering elements 20, 21. For this purpose the mounting members 18 and 19 for the centering elements 20, 21 are shiftable relative towards one another in direction of elongation of the respective traverse member 17, that is transversely of the elongation of the chains 15. It is shown in FIG. 1 that each of the chains 15 has associated with it a guide rail 75. The mounting members 18 are provided with guide rollers 76 which engage the rail 75 at opposite sides. The contour of the rails 75, or at least one of them, is so selected that their spacing in the region of the location at which the objects 12 are supplied to the chains 15, is greater than in the region associated with the printing stations 13, 14. This means that the two centering elements 20, 21 will be spaced from one another by a greater distance in the first-mentioned region than is illustrated in FIG. 1, and this spacing between the rails 75 decreases in the direction towards the first printing station 13 until the spacing shown in FIG. 1 is reached. As a result of this the centering elements 20 and 21 move with their mounting members 18, 19 on the chains 15 transversely towards one another as they travel towards the first printing station 13 in the direction 11, until they engage the object 12, center it and position it. No later than immediately ahead of the first printing station 13 the gear 24 engages the rack 16. Of course, the arrangement may also be such that the rack 16 extends along the entire length of the linear runs of the chains 15, so that the gear 24 will always be in engagement with the rack 16 during its travel along this run.

Figure 2:
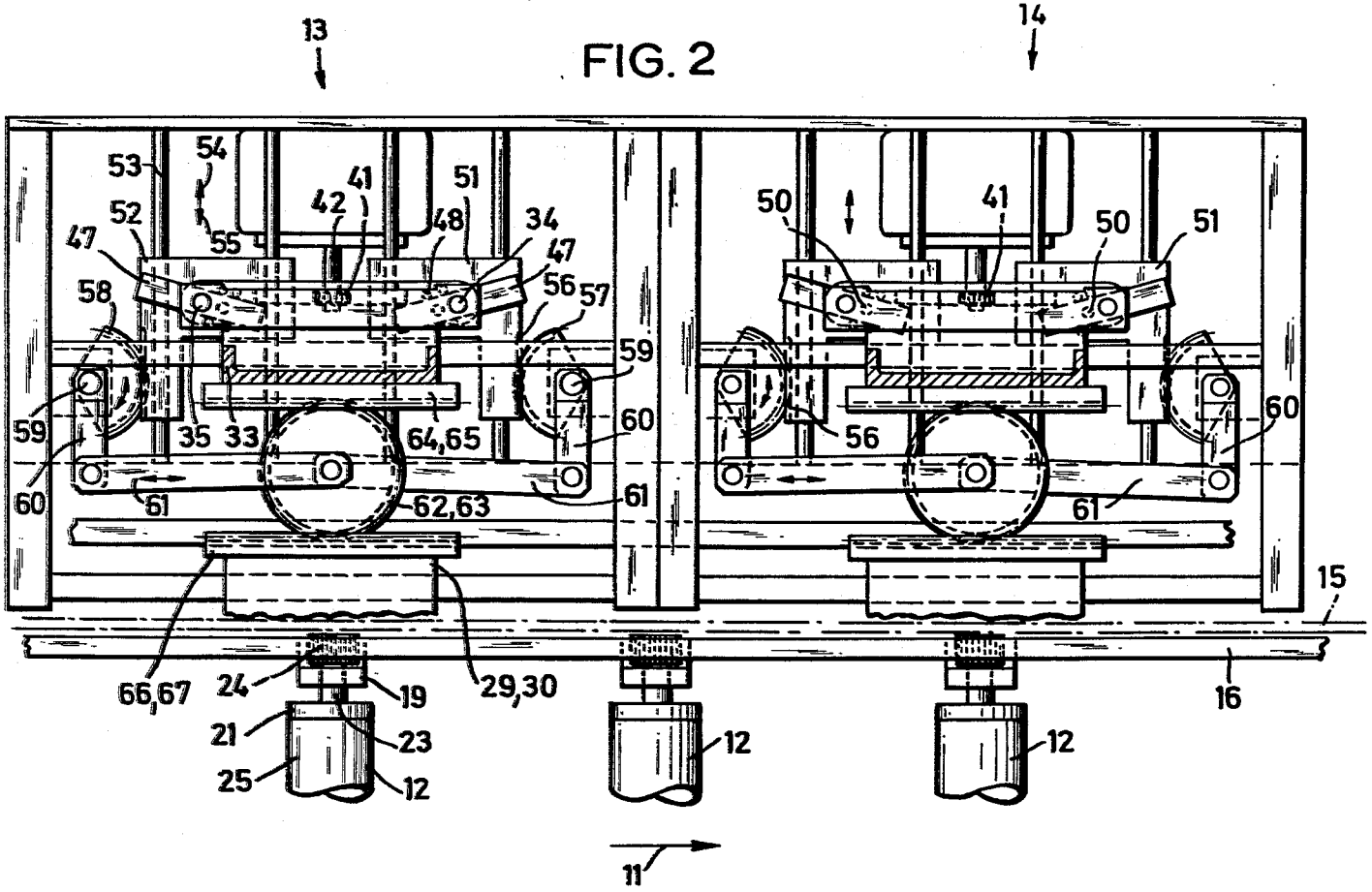
FIG. 2 is a fragmentary top-plan view of FIG. 1 on an enlarged scale.
Figure 3:
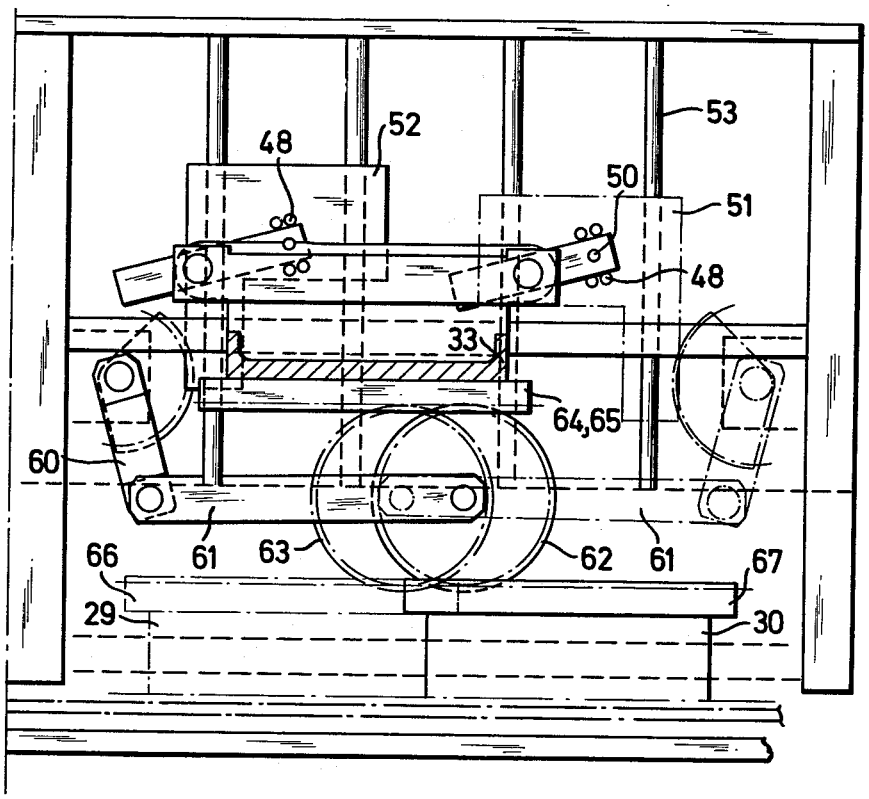
FIG. 3 is a fragmentary enlarged-scale detail view of FIG. 2, but with certain components illustrated in different positions than they assumed in FIG. 2.
Figure 5:
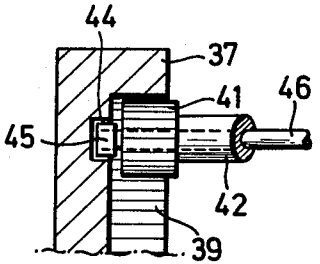
FIG. 5 is a section on line V—V of FIG. 4.
Figure 4:
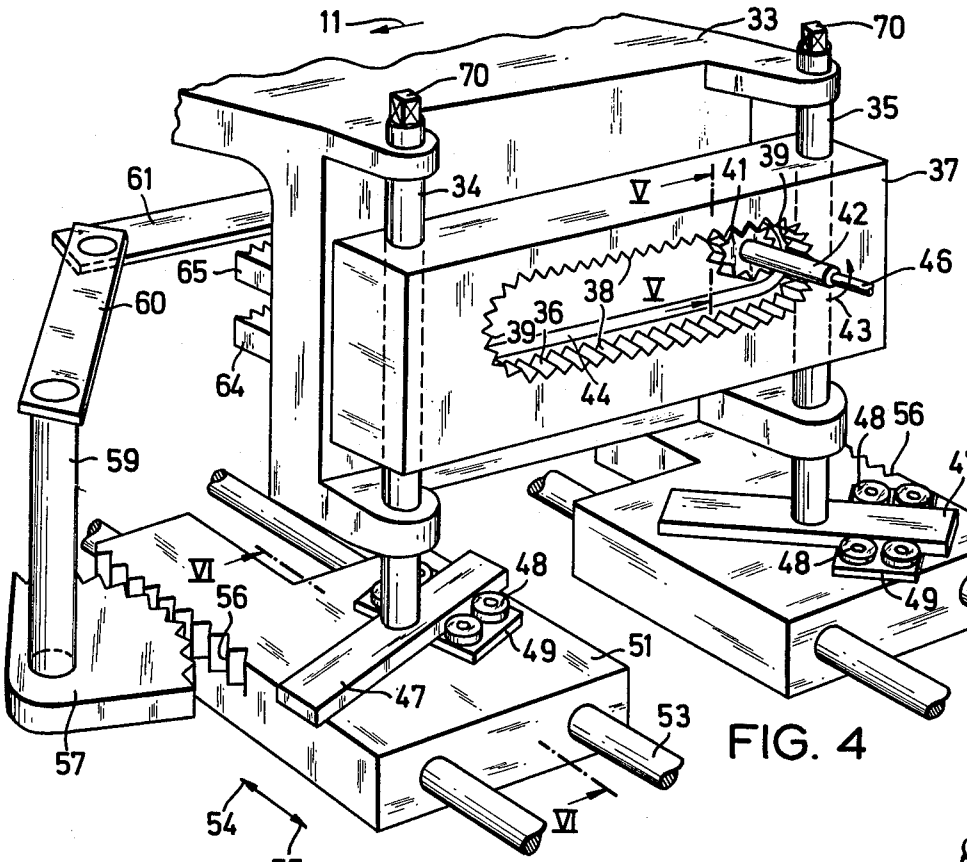
FIG. 4 is an enlarged-scale perspective detail view illustrating a detail of FIGS. 1–3.
Figure 6:
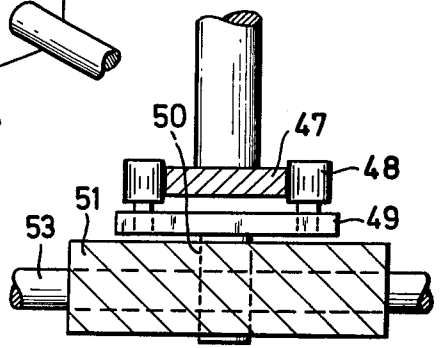
FIG. 6 is a section taken on line VI—VI of FIG. 4.

During the continuous transportation of the object 12 in the direction of the arrow 11 the gear 24 causes the object 12 to be rotated, due to its engagement with the rack 16. While being so rotated, the object 12 reaches the first printing station 13 in which a first image is printed onto the neck 26 and the body 25 of the object 12. The printing screens 27 and 28 are controlled independently of one another in the manner already described. Thereupon the object 12 travels to the second printing station 14 where the next printing operation on the body 25 and the neck 26 takes place and where again the printing screens are independently conrolled. FIG. 2 shows the position of the components associated with the printing stations 13 and 14 in their intermediate position during the printing operation. FIG. 3 shows the starting position of the components of one of the printing stations immediately before the printing operation begins.

In each of the printing stations 13, 14 the object 12 to be printed is turned through 360°. The arrangement is such that each object also performs either one or several complete rotations during its travel from one to the next printing station. In any case it is assured that due to the guidance by the stationary rack 16 the object 12 will always be in a precisely predetermined and precalculatable starting position before it reaches any of the printing stations, so that there is an absolute assurance that the individual images printed by the respective printing stations will be affixed to the precisely predetermined portions of the object, independently of the number of the printing stations and consequently the number of printing operations.

If desired, appropriate measures may be taken to facilitate rapid drying of the printing ink between the individual printing stations and of course also downstream of the terminal one of the printing stations.

The cooperation of squeegee and associated printing screen can take place in the conventional manner that is known from the art. The arrangements which control the movements of the printing screen in direction normal to the general plane of the printing screen and also the movements of the squeegee are not separately illustrated in the drawing and can be of the type conventionally used in the art and well known to those conversant in this field. Of course, it is also possible to utilize the upwards and downward movement of the element 37 which result from cooperation of the track 36 with the pinion 41 to control these movements of the screens or particularly of the squeegee. In the latter case, this movement of the element 37 would have to be transmitted to the squeegee which is mounted on the carriage 33.

The operation of the intermediate gears is of course also not limited to the components which have been illustrated in FIGS. 1–6. Other means may be employed for effecting the rotation of these intermediate gears, and also the movement of the linking member 61. The embodiment illustrated in FIGS. 1–6 has the advantage, however, that it directly effects the movement of the intermediate gears in dependence upon the movement of the carriage 33, so that there is synchronism between these movements.

It has already been mentioned that a particular advantage of the present invention resides in the fact that a precise orientation of the objects 12 relative to the individual printing stations 13, 14 and therefore a precise registration of the images being printed at these stations relative to one another, is obtained without any special measures and without special equipment. In addition, each printing station 13, 14 may be provided with a separate centering device if such is desired. Such devices are identified in FIG. 1 by the arrows 77. For example, each device may utilize two engaging portions that can be shifted by respective cylinders or the like and which engage into appropriate recesses at the ends of the traverse members 17 or into the chains 15 themselves, to precisely guide the traverse members 17 during the printing operation, and therefore to precisely guide the objects 12 carried by the traverse members 17. Thus such a guidance would be more precise than could normally be obtained by the chains 15. However, such separate centering devices need be employed if at all, only for particular requirements since for ordinary use the measures described earlier are fully satisfactory.

Figure 8:
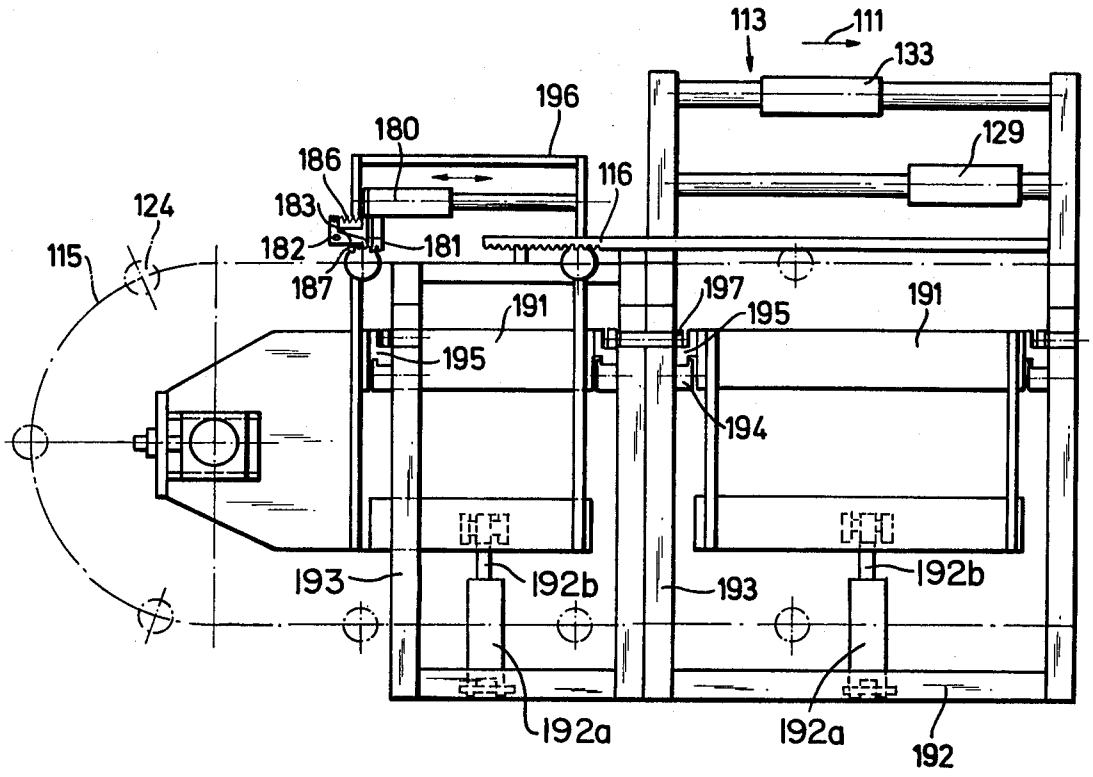
FIG. 8 is a fragmentary side-elevation of a further embodiment of the invention.
Figure 9:
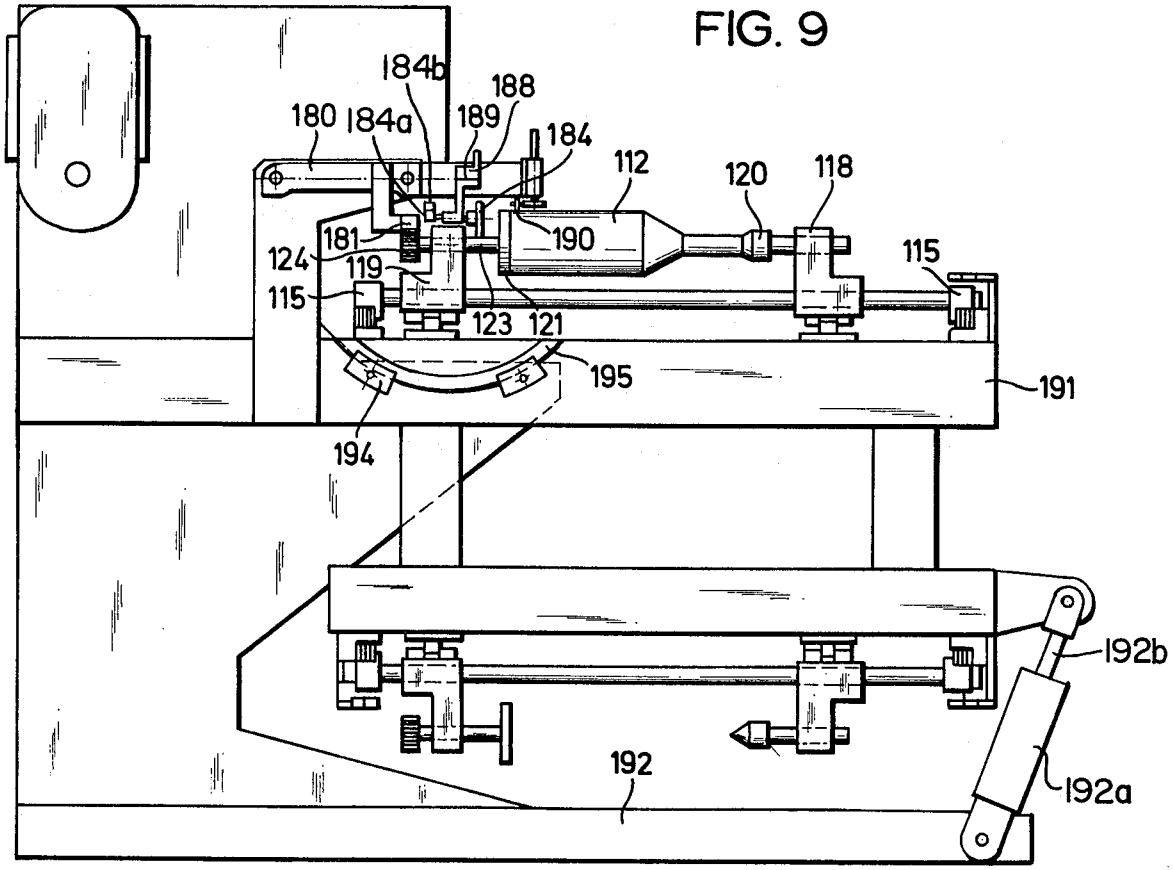
FIG. 9 is an end view of FIG. 8, looking towards the right.

Coming now to the embodiment in FIGS. 8 and 9 it will be understood that this corresponds largely to the one in FIGS. 1–6. For this reason, the same reference numerals have been employed for like elements as in FIGS. 1–6, but for differentiation these reference numerals have been provided with the prefix 1. Thus, the printing station 113 in FIGS. 8 and 9 may be the first of several printing stations that are arranged one behind the other in the direction of advancement indicated by the arrow 111. Located ahead of the printing station 113 is a carriage 180 that is reciprocable and carries a rack section 181, a pawl 183 that is pivoted at 182, a friction wheel 184 and a feeler 190. The pawl 183 can be pivoted counter to the force of the spring 186 and is located ahead of the rack section 181 as seen in the direction of the arrow 111. The rack section 181 in effect constitutes an elongation of the stationary rack 116 and can move between two end positions, and the right-hand one of which the rack section 181 engages the stationary rack 116. The purpose of the rack section 181 and the pawl 183 is to assure that the gear 124 is so oriented in circumferential direction relative to the rack 116 before it becomes engaged with the latter, that the meshing between the teeth of the gear 124 and the rack 116 during further movement in the direction of the arrow 111 can take place without any difficulties. When the gear 124 travels in the direction of the arrow 111 and reaches the vicinity of the pawl 183, there will be a relative speed between the movement of the gear 124 in the direction of the arrow 111 on the one hand, and the movement of the pawl 183 carried by the carriage 180 on the other hand, of such magnitude that the gear 124 (and an object 112 carried by it, as shown in FIG. 9) travel faster than the pawl 183. During the movement the tooth 187 of the pawl 183 engages the gear 124, and the differential speed causes turning of the gear 124 about the axis of the shaft 123. The arrangement is such that at the end of the turning movement, when the gear 124 on the one hand and the tooth 187 of the pawl on the other hand, move out of engagement with one another, the gear 124 will assume an angular position relative to the rack section 181 in which the gear 124 during its further travel can move into engagement with the teeth of the rack section 181 without any difficulties. The gear 124 remains in engagement with the teeth of the rack section 181 during its travel in the direction of the arrow 111 until the movement of the rack section 181 is terminated, so that when the rack section 181 engages the stationary rack 116 and thus constitutes an extension of the latter, the gear 124 simply travels from the rack section 181 into the teeth of the rack 116 without any problems. As soon as the gear 124 meshes with the rack 116, the carriage 180 is reversed and travels counter to the direction of the arrow 111, in order to cooperate with the next-following gear 124 to properly orient it as described above.

In some instances it may be necessary to align the object 112 with respect to the printing screen that is not illustrated in FIGS. 8 and 9. This is done by turning the object 112 about its longitudinal axis with respect to the associated gear 124, utilizing the earlier-mentioned friction wheel 184 which engages the shaft 123 carrying the centering element 121 as shown in FIG. 9, and which is carried by an arm 188 that is mounted on the shaft 180 for pivoting movement about an axis 189. The carriage 180 carries a gear **184*a* which meshes with a stationary rack 184*b*. Due to the to-and-fro movement carried out by the carriage 180 the gear 184*a* is turned, and this turning movement effects via appropriate components a rotation of the friction wheel 184 which in turn transmits its rotation to the shaft 123. This means that the centering element 121 and therefore the object 112 can be readily moved to a certain angular position relative to the gear 124. The control of the operation of the friction wheel 184 is effected by the feeler 190 that engages the circumference of the object 112. As soon as the feeler 190 feels (during the rotation of the object 112) an appropriate marking, a projection, a flattened portion or the like on the exterior of the object 112, the object is braked by the feeler 190 for which purpose the friction wheel 184 is prevented from further rotating the shaft 123 by appropriate means that are well known to those skilled in the art. At this time the object 112 assumes a certain position which is determined by the mark that has been sensed by the feeler 190. Thereafter, the arm 188 is pivoted to disengage the friction wheel 184 from the shaft 123 and the feeler 190 disengages the object 112 so that the latter can freely rotate as soon as the gear 124 meshes with the teeth on the stationary rack 116**.

The preliminary measures carried out with the embodiment of FIGS. 8 and 9 therefore will be seen to be such that as the gear 124 travels in the direction of the arrow 111 it will first pass the pawl 183 and be turned by the latter to properly angularly orient it with reference to the rack section 181, whereupon the carriage 180 and therefore the section 181 travel synchronously with the chains 115 and therefore with the gear 124. During this synchronous movement the object 112 is oriented with respect to the feeler 190 after the latter and the friction wheel 184 have been moved to their respective operating positions. After the orientation of the object 112 the friction wheel 184 and the feeler 190 are disengaged from the object and when the carriage 180 has reached its terminal position of movement in direction of the arrow 111, the gear 124 comes into meshing engagement with the stationary rack 116.

The movement to-and-fro of the carriage 180 can be effected by means of an internal gear track, similar to the arrangement described earlier with respect to FIG. 4 relative to the element 37, with which a driven pinion may engage corresponding to the pinion 41.

The chains 115 constituting the conveyor are carried by a frame 191 which is pivotably mounted on the machine frame 192 (see FIGS. 8, 9). For this purpose the supports 193 of the machine frame 192 are provided with supporting elements 194 having arcuately curved contact surfaces. The frame 191 is provided with correspondingly formed slide elements 195 which are supported on the supporting elements 194 and can be tilted relative to the same, with the result that a tilting of the elements 195 causes a tilting of the entire frame with the chains 115, the rack 116, and the other components. In this manner, the elements 118, 119 and therefore the centering elements 120, 121 can be moved to a position in which the object 112 mounted by the elements 120, 121, or rather its surface that is to be printed upon, extends parallel to the printing screen (e.g. substantially horizontal) even if the objects 112 have for example a conical configuration. The arrangement is advantageously such that several spindles or cylinder or other drive means are provided, distributed over the length of the machine and which can be simply actuated in order to transmit the necessary motive force to the frame 191. By way of example, cylinder-and-piston units 192*a*, 192*b* are, illustrated in FIGS. 8 and 9. As indicated in FIG. 8, the frame 191 may be composed of individual sections, and each section may have a separate drive if desired. However, the frame 191 may clearly be a unitary structure and then all of the drives would act upon it and would centrally be controlled.

Pusher members 197 are removably mounted on the machine frame 191 which engage into the members 195 so that the latter are guided between the members 194 and 197.

Figure 10:
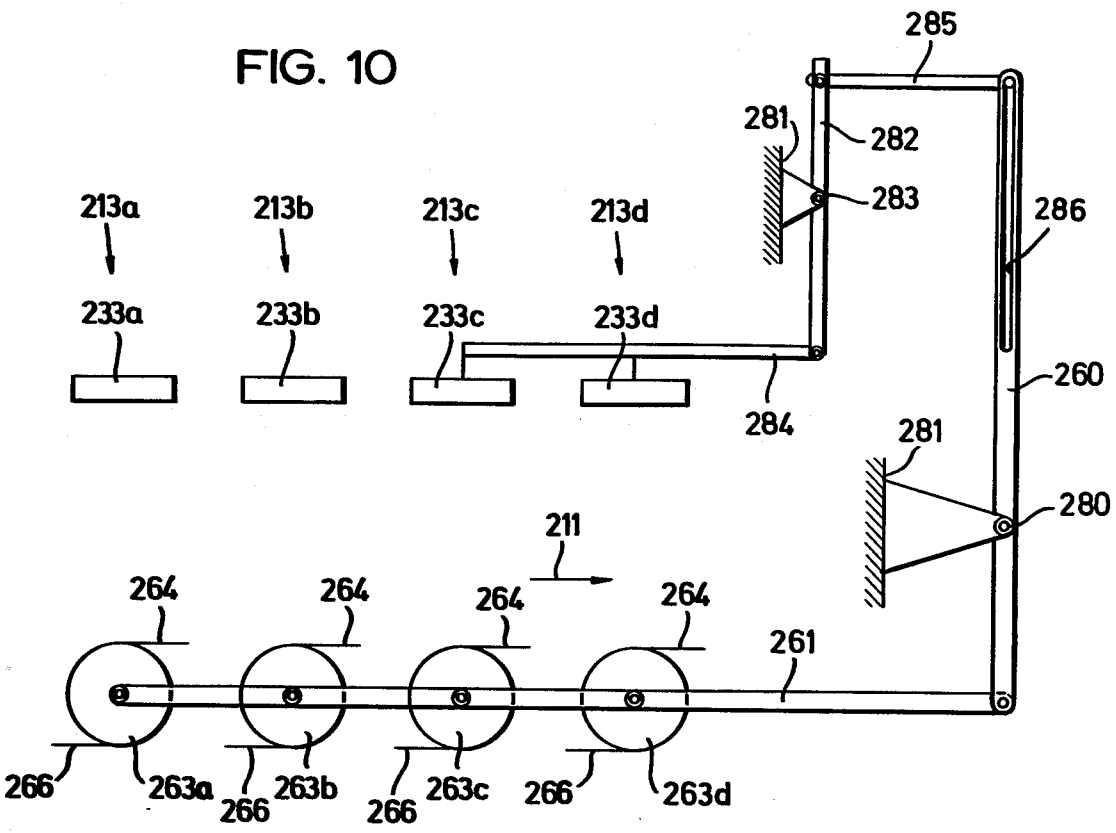
FIG. 10 is a diagrammatic illustration showing drive means for the printing screens in a further embodiment of the invention.

An additional embodiment of the invention is diagrammatically illustrated in FIG. 10. Since the structural details have already been shown in the preceding embodiments, the illustration in FIG. 10 is simplified so as to explain the principle of that embodiment. FIG. 10 illlustrates an embodiment of a screen-printing machine having four printing stations 213*a*, 213*b*, 213*c* and 213*d*. Each of these printing stations is provided with the various components described with reference to the preceding embodiments, inter alia with a carriage 233*a*, 233*b*, 233*c* and 233*d* for the respective squeegee and an intermediate gear 263*a*, 263*b*, 263*c* and 263*d*, respectively. Each of these intermediate gears cooperates in the manner described with reference to FIGS. 7A – 7C with two racks 264, 266. The racks 264 are each carried by the respective carriages 233*a* – 233*d*, whereas the racks 266 are each carried by the respective carriages (not illustrated) which support the printing screens (also not shown). The intermediate gears 263*a* – 263*d* are all supported on a common mount 261 which is constructed as a linking member having one end that is connected with a double-armed lever 260 which is pivotable about the pivot 280 and mounted on the machine frame 281. A further lever 282, advantageously also the double-armed type, is pivoted on the machine frame 281 for pivoting movement about a pivot axis 283; one of its ends is articulated to a traverse member 284 which is mounted on the two carriages 233*c* and 233*d*.

A further linking member 285 has ay one end a portion which slidably extends into a slot 286 of the lever 260, and its other end is is articulated upper end to the lever 282. The linking member 285 is displaceable in longitudinal direction of the two levers 260 and 282 and in its respective selected position it can be arrested by appropriate means not illustrated but well known to those skilled in the art. The movement of the linking member 261 and of the gears 263*a* – 263*d* carried by it, is effected in dependence upon the position of the linking member 285. Due to the movements performed by the carriages 233*c* and 233*d*, the traverse member 284 is reciprocated in and opposite to the direction of the arrow 211, and this causes corresponding pivoting of the double-armed lever 282, whose movements are transmitted via the linking member 285 to the lever 260 and from the same to the linking member 261 and the gears 263*a* – 263*d*. The type and extent of the movements performed by the lever 260 and therefore the gears 263*a* – 263*d*, depend upon the position of the linking member 285 so that a displacement of the linking member 285 in parallelism with itself permits an accommodation of the arrangement to the particular diameters of the objects to be printed.

When the linking member 285 is in the position shown in FIG. 10, a movement in direction of the arrow 211 is transmitted during the printing operation upon the linking member 261, and this movement causes a corresponding displacement of the gears 263*a* – 263*d*. In this position of the linking member 285 the relationships that exist correspond to approximately those described with reference to FIG. 7B.

On the other hand, when the linking member 285 is positioned in the region of the fixed pivot 283, the lever 260 has no motion transmitted to it, analogous to the conditions that have been described with reference to FIG. 7A, so that the movement of the racks 264 and therefore of the respectively associated printing screen carriage (not shown in FIG. 10) results exclusively from the rotary movements of the respective intermediate gears 263*a* – 263*d* and therefore are based upon the linear displacement of the respective rack 266.

Finally, if the linking member 285 is positioned to be approximately at the lower end of the elongated slot 286 in the lever 260, a movement of the linking member 261 during the printing operation counter to the direction of the arrow 211 will result, corresponding to the situation described with respect to FIG. 7C.

It is clear that in deviation from the illustration in FIG. 10, the movements for the intermediate gears 263*a* – 263*d* may also be derived from only a single one of the carriages 233*a* – 233*d*, respectively. Again, it is possible to have a common mount for a different number of the gears 263*a* – 263*d*, for example for two or three of them, and to have this driven by one or more of the carriages 233*a* – 233*d*. The optimum arrangement will depend upon the particular requirements, for instance upon the size of the total machine, the space availability, distances between the individual printing stations, and the like. It can be readily determined by those skilled in the art without any undue experimentation.

Figure 11:
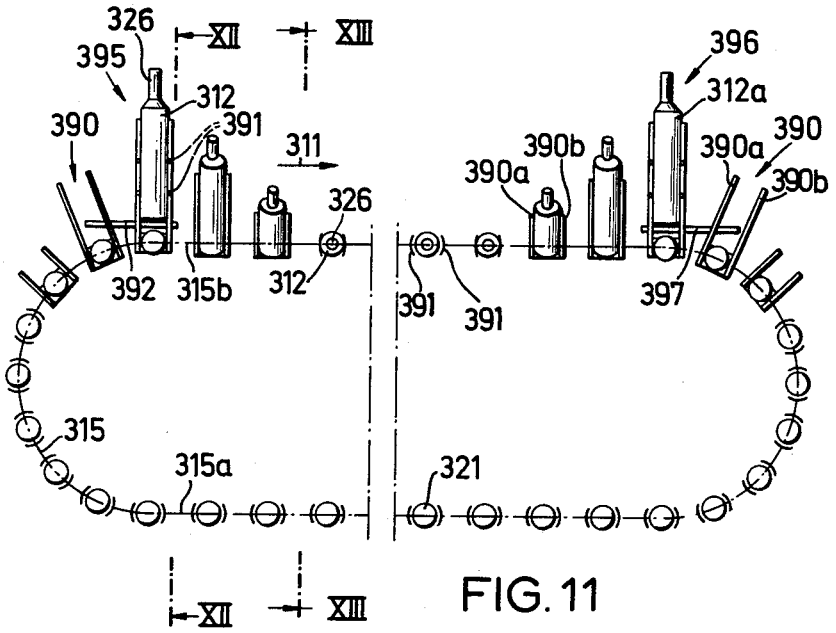
FIG. 11 is a diagrammatic fragmentary front view of a further embodiment of the invention.
Figure 12:
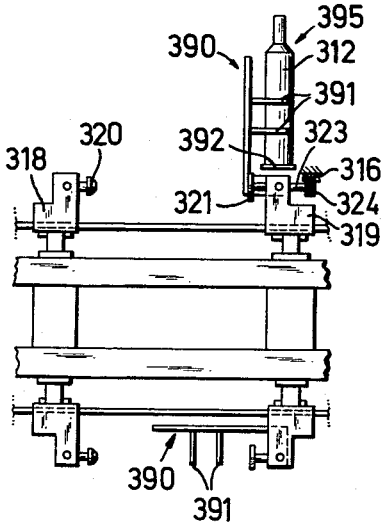
FIG. 12 is a section taken on line XII—XII of FIG. 11.
Figure 13:
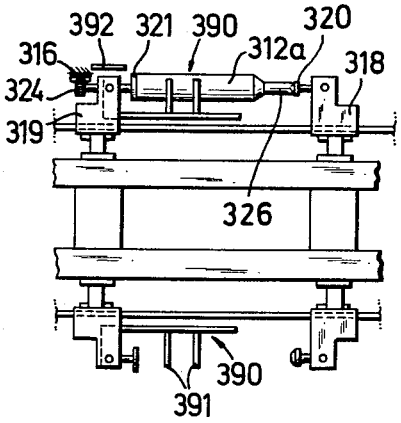
FIG. 13 is a section taken on line XIII—XIII of FIG. 11.

Finally, FIGS. 11 – 13 illustrate an embodiment of the invention in which the machine is provided with arrangements for depositing the objects 312 that are to be printed into the holding devices composed of the portions 318 and 319, and with arrangements for removing the printed object 312*a*, from the holding devices 318 and 319 to furnish them to a subsequently arranged machine.

In FIGS. 11 – 13 each holding device is provided with a gripper 390 which in this embodiment is mounted on the respective portion 319 of the holding device and which has two gripper sections 390*a*, 390*b*. These gripper sections are provided with approximately transversely extending ribs, ridges or the like 391, of which the ribs 391 of the respective sections 390*a* and 390*b* advantageously extend parallel to each other. Each of the grippers 390 is pivotably mounted on the respective portion 319.

The objects 312 that are to be printed are supplied via a conveyor 392 to a receiving station 395. The holding devices having the portions 318, 319 travel in the direction of the arrow 311 due to being mounted on a pair of chains 315 or an analogous conveying device. Each set of portions 318, 319 engages an object 312 that is supplied on the conveyor 392 and has become located at the receiving station 395. For this purpose, as each set of portions 318, 319 approaches the location of the object 312 to be engaged, the associated gripper 319 is initially pivoted upwardly from its rest position in which travels substantially parallel to the traverse member 317, to the position which is shown at the upper end of FIG. 12. For this purpose appropriate guiding devices, such as rails are provided which are engaged by the gripper sections 390*a* and 390*b*. The arrangement is such that this upward pivoting of the gripper 390 takes place in the region of the upper half of the transition from the lower run 315*a* to the upper run 315*b* of the conveyor 315. The tilting movement of the grippers 390 is so controlled that the gripper sections 390*a* and 390*b* reach their upper end position when the object 312 that is located on the conveyor 392 is positioned between them. At this time the previously opened gripper 390 is moved to closed position, so that the gripper sections 390*a* and 390*b* engage with their ribs 391 the object 312 located between them. During the further movement in the direction of the arrow 311 the gripper 390 is returned to its position extending parallel to the traverse member 317, until it assumes the position shown in FIG. 13, together with the object 312 which it holds. Now the engaging portions 318, 319 are shifted towards one another in axial direction of the object 312 until the latter is held by them, whereupon the gripper 390 is opened to release the object 312 so that the latter can now perform the necessary movements in preparation for printing.

After the printing is completed, the gripper 390 which still extends parallel to the traverse member 317, is closed again so that it now re-engages the printed object 312*a*. The holding portions 318, 319 are moved away from each other to release the object 312*a* and the gripper 390 is now pivoted upwards again to a position in which the longitudinal axis of the object 312*a* extends vertically when the object 312*a* reaches the discharge station or transfer station 396. The station 396 has associated with it a further conveyor or the like 397 which receives the printed object 312*a*.

During the advancement of the conveyor 315 in the direction of the arrow 311 each printed object 312*a* is placed by its associated gripper 390 onto the conveyor 397. As soon as it is located on the conveyor 397, the gripper sections 390*a*, 390*b* move apart to disengage the object 312 and thereafter the gripper 390 is pivoted back to its rest position. This operation takes place in the illustrated embodiment in the upper region of the right-hand transition from the upper run 315*b* to the lower run 315*a* of the conveyor 315 (see FIG. 11).

In all other respects the embodiment of FIGS. 11 - 13 corresponds to that described for example with respect to FIGS. 1 - 10, so that like reference numerals have been used for like components, prefixed only by the suffix 3.

The embodiment in FIGS. 11 - 13 has the advantage that the object 312 can be moved to the position which they must assume for printing purposes, without any difficulties at all. Normally the objects to be printed are supplied in upright position, but msut be turned to a prone or lying-down position for printing purposes. This can be done in a very simple manner with the embodiment of FIGS. 11 - 13. It is further important that the objects 312 have precisely the speed of movement of the conveyor 315 at the time at which they are engaged by the holding portions 318, 319, and have precisely the speed of movement of the conveyor 397 at the time of which they are discharged. This is accomplished in a simple manner by the embodiment of FIGS. 11 - 13, which is structurally very simple and uncomplicated. In particular, it is not necessary to provide special drives for the grippers 390, since the movements of the grippers and of their gripper sections can be controlled by cams which extend along the path of movement of the grippers 390, thus eliminating the need for separate drives.

It will be appreciated that the movement of the elements 37 (or analogous components) and of the intermediate gears may be controlled by a single or several squeege carriages, such as the carriage 33 of FIGS. 1 - 6, even though the number of such elements (in correspondence with the number of printing stations of the machine) may be larger than the number of squeegee carriages. In other words, the elements 37 or squeegee carriages of a plurality of printing stations can be driven by a single element which is appropriately linked with them, or by two or more such elements although of course each element 37 at each printing station may be separately controlled for movement. The toothed track 36 of the element 37 in FIG. 4 or any of the other embodiments could of course be replaced with analogous means, for example the element 37 could be constructed as a friction element, as an endless chain or the like, and cooperate with appropriate corresponding components, such as friction rods or the like. The same is true with respect to to the gear 24, which could also be replaced by a friction wheel, endless chain or the like. In the embodiment of FIGS. 1 - 6 it is advantageous if the track 36 is located in a plane extending normal to the general plane of the associated printing screen. The pawl 183 described with respect to the embodiment in FIGS. 8 and 9 as being mounted on the carriage 180, could also be mounted stationarily instead of on the carriage 180. One of the advantages of the gripper 390 described with reference to FIGS. 11 - 13 is the fact that is is not necessary that the objects 312 have a particular oerientation at the time at which they are engaged by the gripper 390 since the closing of the gripper sections 390*a* and 390*b* around the respective object 312 will automatically result in a movement of the object to a predetermined position, since the object can assume only a single position in the gripper when the latter is closed. This, in turn, then leads to the object being forced to assume a precisely predetermined angular position with reference to its own axis of rotation and to the engaging portions 318, 319 to which it is subsequently transferred. In each instance it is advantageous if the stroke or movement performed by the squeegee corresponds with the distance traversed by the gear 24 as the latter performs a complete revolution in engagement with the teeth of the stationary rack 16.

It will be understood that each of the elements described above, or two or more together, may also find a useful application in other types of constructions differing from the types described above.

While the invention has been illustrated and described as embodied in a screen-printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a screen-printing machine for printing on rotatably-held objects of different diameters, a combination comprising support means; at least one printing station on said support means and past which an object to be printed travels in a path in a predetermined direction, and which includes a movable printing screen and a cooperating movable squeege; means for uniformly rotating said object to be printed at a fixed number of revolutions per unit time, including a gear and a rack extending along said path, said rack being fixed in position on said support means and located at said one printing station so as to be stationary in said direction of movement and also meshing with said gear to rotate said object at a constant rate of peripheral speed for an object of a given diameter; means for moving said squeege at a constant rate of speed; means for adjusting the speed of movement and the stroke of said printing screen whenever an object of a different diameter and therefore of a different peripheral speed than before is to be printed, whereby the periphery of each object is printed at a uniform speed; mounting means for mounting said printing screen, and mounting means for mounting said squeegee; a movable element connected between both of said mounting means and mounted on a support which is movable to-and-fro in said path; and drive means for imparting to-and-fro movements to said movable element so as to effect relative movement between said printing screen and said squeegee.

2. A combination as defined in claim 1, said drive means comprising a first rack member fixedly mounted on said mounting means for said squeegee, and a second rack member fixedly mounted on said mounting means for said screen, said first and second rack members being in motion-transmitting engagement with said movable element.

3. A combination as defined in claim 1; further comprising centering means for engaging and centering said object by rotating the latter; a drive for rotating said centering means, said drive including a drive wheel in motion-transmitting engagement with a shaft which is connected to said centering means; and feeler means ahead of said printing station and positioned for engagement with and feeling of the object travelling in said path, said feeler means being operative for controlling the operation of said drive wheel.

4. A combination as defined in claim 1, wherein said mounting means for said printing screen includes a printing screen carriage and said mounting means for said squeegee includes a squeegee carriage, and each of said carriages is provided with a rack; and wherein said element is a gear meshing with said racks.

5. A combination as defined in claim 1; further comprising an endless conveyor for carrying said object.

6. A combination as defined in claim 5, wherein said conveyor comprises two parallel endless conveyor loops, a plurality of traverse members connecting said conveyor loops at spaced locations, and engaging members for said object mounted on said traverse members.

7. A combination as defined in claim 6, further comprising centering means at said printing station for centering at least said engaging members and said object with reference to said printing screen and squeegee.

8. A combination as defined in claim 1; further comprising engaging means on said machine for engaging said object, including an engaging device and a gripper movable relative thereto.

9. A combination as defined in claim 8, and means directly connecting said gripper with said engaging device.

10. A combination as defined in claim 8, wherein said engaging device comprises two engaging portions, and said gripper is carried by one of said engaging portions.

11. A combination as defined in claim 8, wherein said engaging device comprises two engaging portions of which one is engageable with a top, and the other is engageable with a bottom of said object; and wherein said gripper is carried by said other engaging portion.

12. A combination as defined in claim 11, wherein said gripper is swingable in a plane extending normal to the direction of movement of said object.

13. A combination as defined in claim 8, wherein said gripper is movable to a first position which it assumes at said printing station and wherein it extends substantially parallel to said engaging device, and to a different second position which it assumes ahead of and beyond said printing station.

14. A combination as defined in claim 1, the object having at least two different-diameter portions, further comprising at least one additional printing screen and at least one additional squeegee at said printing station, each printing screen and squeegee being operative for printing on one of said portions so that said portions may be printed simultaneously.

15. A combination as defined in claim 14, wherein each of said printing screens is provided with a separate means for adjusting.

16. A combination as defined in claim 14; said squeegee mounting means comprising a squeegee carriage supporting both of said squeegees.

17. A combination as defined in claim 1; further comprising at least one additional printing station also having a movable element identical to the first-mentioned movable element, said movable elements both being mounted on said support.

18. A combination as defined in claim 17, wherein said squeegee includes a carriage for each printing station; and wherein said drive means drives said common support and receives motion from at least one of said carriages.

19. A combination as defined in claim 1, wherein said mounting means for said squeegee includes a carriage formed with a set of teeth and guide means guiding said carriage for reciprocating movement; and a further comprising a pinion meshing with said teeth and operative to effect reciprocating movement of said carriage.

20. A combination as defined in claim 3, wherein said drive wheel is a friction drive wheel.

21. A combination as defined in claim 3; further comprising a supporting carriage on which said feeler means and said drive are mounted.

22. A combination as defined in claim 20, wherein said friction drive wheel is mounted on a movable support.

23. A combination as defined in claim 21, said supporting carriage being movable in and opposite to the direction of travel of said object; and means for causing said supporting carriage to travel in synchronism with said object during at least a portion of its movement in said direction of travel.

24. A combination as defined in claim 21; further comprising a carrier for said object; and a tiltable elongated mounting structure supporting said carrier, said rack and said supporting carriage.

25. A combination as defined in claim 24; further comprising a machine frame; supporting members mounted on said machine frame and having arcuate contact surfaces; and cooperating supporting members mounted on said mounting structure and having corresponding contact surfaces which slidably engage said arcuate contact surfaces.

26. A combination as defined in claim 24, and further comprising a plurality of drive members distributed over the elongation of said mounting structure for tilting the same, said drive members being centrally actuatable.

27. A combination as defined in claim 21, said supporting carriage being mounted for reciprocal movement in a path; and further comprising a rack member adjacent said path of movement of said carriage; and a gear meshing with said rack member and connected with said drive for operating the latter.

28. A combination as defined in claim 22; and further comprising a guide rail for said centering means.

29. A combination as defined in claim 9, wherein said means connecting said gripper with said engaging device pivotably connects the former with the latter.

* * * * *